US005476188A

United States Patent [19]

Hassenpflug

[11] Patent Number: 5,476,188

[45] Date of Patent: Dec. 19, 1995

[54] GUN BOOT

[76] Inventor: Robert S. Hassenpflug, 5200 NE Richmond, Kansas City, Mo. 64119

[21] Appl. No.: 369,080

[22] Filed: Jan. 5, 1995

[51] Int. Cl.[6] ..... B65D 65/00

[52] U.S. Cl. ..... 220/480; 220/666; 206/317; 190/104; 42/96

[58] Field of Search ..... 220/480, 666; 42/96; 150/154; 206/315.3, 315.11, 316.1; 190/103, 104

[56] References Cited

U.S. PATENT DOCUMENTS

| | | | |
|---|---|---|---|
| 1,607,820 | 11/1926 | Frisk | 206/315.3 X |
| 2,670,776 | 3/1954 | Benner | 190/103 X |
| 2,682,439 | 6/1954 | Joy | 206/317 X |
| 2,901,018 | 8/1959 | Kolpin | 206/317 X |
| 3,239,114 | 3/1966 | Norsworthy | 206/317 |
| 4,312,431 | 1/1982 | COrey | 190/104 |
| 5,027,963 | 7/1991 | Robbins, III | 220/666 X |

*Primary Examiner*—Steven M. Pollard

[57] ABSTRACT

A gun boot comprising a hollow base having an open upper end and an open lower end; a mounting bracket secured to the base and removably securable to a tree stand; an upper lid removably coupled to the upper end of the base; a lower lid removably coupled to the lower end of the base; and a generally cone-shaped hollow flexible holster portion having a larger open upper extent and a smaller sealed lower extent with the upper extent secured to the lower end of the base, the holster portion positionable in an extended orientation with the lower extent projected from the lower end of the base and further positionable in a retracted orientation within the base.

8 Claims, 3 Drawing Sheets

GUN BOOT

BACKGROUND OF THE INVENTION

1. Field of the Invention

The present invention relate to a gun boot and more particularly pertains to holding a shotgun, rifle, or scope mounted rifle with respect to a tree stand while hunting with a gun boot.

2. Description of the Prior Art

The use of containers for holding various objects constructed of a wide variety of designs and configurations is known in the prior art. More specifically, containers for holding various objects constructed of a wide variety of designs and configurations heretofore devised and utilized for the purpose of holding objects at a predetermined location by any of a plurality of methods and apparatuses are known to consist basically of familiar, expected and obvious structural configurations, notwithstanding the myriad of designs encompassed by the crowded prior art which have been developed for the fulfillment of countless objectives and requirements.

By way of example, U.S. Pat. No. Des. 314,469 to Chilcutt discloses a tree stand gun holder. U.S. Pat. No. Des. 325,300 to Miklus, II discloses a shotgun and rifle holster. U.S. Pat. No. 3,620,493 to Huver discloses a gun hanger. U.S. Pat. No. 3,869,074 to Roach discloses a shotgun-rifle holder. U.S. Pat. No. 3,953,014 to Mendell, Jr. discloses a holding means. U.S. Pat. No. 5,029,741 to Easter discloses a firearm holding apparatus.

While these devices fulfill their respective, particular objective and requirements, the aforementioned patents do not describe a gun boot that is removably attachable to a tree stand and is extendable in one orientation for use and retractable in another orientation for stowage.

In this respect, the gun boot according to the present invention substantially departs from the conventional concepts and designs of the prior art, and in doing so provides an apparatus primarily developed for the purpose of holding a shotgun, rifle, or scope mounted rifle with respect to a tree stand while hunting.

Therefore, it can be appreciated that there exists a continuing need for new and improved gun boot which can be used for holding a shotgun, rifle, or scope mounted rifle with respect to a tree stand while hunting. In this regard, the present invention substantially fulfills this need.

SUMMARY OF THE INVENTION

In the view of the foregoing disadvantages inherent in the known types of containers for holding various objects constructed of a wide variety of designs and configurations now present in the prior art, the present invention provides an improved gun boot. As such, the general purpose of the present invention, which will be described subsequently in greater detail, is to provide a new and improved gun boot and method which has all the advantages of the prior art and none of the disadvantages.

To attain this, the present invention essentially comprises, in combination, a rigid base formed in a tubular configuration having an interior surface and an exterior surface with an upper end and a lower end. A rigid mounting bracket is included and formed of a first part and a separate second part. The first part has an L-shape with a horizontal lower leg, an upstanding upper leg, and coupling means for securing the lower leg to a tree stand. The second part has a plate secured to the exterior surface of the base and a section having an L-shape extended downwards therefrom. The section and plate of the second part define a space therebetween for receiving the upper leg of the first part for coupling the base with a tree stand. An upper lid is included and has a circular surface positionable over the upper end of the base, a peripheral sidewall extended outwards from the surface, an upper hinge coupled between the sidewall and exterior surface of the base for pivotally coupling the upper lid with the base, and a snap formed between the upper lid and exterior surface of the base at a location diametrically opposed from the upper hinge for allowing the lid to be secured to the base. A lower lid is included and has a circular surface positionable over the lower end of the base, a peripheral sidewall extended outwards from the surface, a lower hinge coupled between the sidewall and exterior surface of the base for pivotally coupling the lower lid with the base, and a snap formed between the lower lid and exterior surface of the base at a location diametrically opposed from the lower hinge for allowing the lid to be secured to the base. A flexible openable loop is included and coupled to the exterior surface of the base and with the loop adapted to receive a rope for allowing the gun boot to be lifted and lowered from a tree stand. Lastly, a generally cone-shaped hollow holster portion formed of a waterproof flexible plastic impregnated fabric with a camouflaged pattern is included and has a larger open upper extent and a smaller open lower extent with the upper extent secured to the interior surface of the base. The holster portion additionally has a cylindrical canvas end cap with a lower circular surface and an upstanding cylindrical side wall secured to the lower extent thereof, a plastic plate secured to the end cap, and a grommet extending through the plate and circular surface for effecting a coupling therebetween. The holster portion is positionable in an extended configuration with the lower extent projected downwards from the base and further positionable in a retracted orientation within the base.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, iris to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in,the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved gun boot which has all the advantages of the prior art containers for holding various objects constructed of a wide variety of designs and configurations and none of the disadvantages.

It is another object of the present invention to provide a new and improved gun boot which may be easily and efficiently manufactured and marketed.

It is a further object of the present invention to provide a new and improved gun boot which is of durable and reliable construction.

An even further object or,the present invention is to provide a new and improved gun boot which is susceptible of a low cost of manufacture with regard to both materials and labor, and which accordingly is then susceptible of low prices of sale to the consuming public, thereby making such a gun boot economically available to the buying public.

Still yet another object of the present invention is to provide a new and improved gun boot which provides in the apparatuses and methods of the prior art some of the advantages thereof, while simultaneously overcoming some of the disadvantages normally associated therewith.

Even still another object of the present invention is to provide a new and improved gun boot for holding a shotgun, rifle, or scope mounted rifle with respect to a tree stand while hunting.

Lastly, it is an object of the present invention to provide a new and improved gun boot comprising a hollow base having an open upper end and an open lower end; a mounting bracket secured to the base and removably securable to a tree stand; an upper lid removably coupled to the upper end of the base; a lower lid removably coupled to the lower end of the base; and a generally cone-shaped hollow flexible holster portion having a larger open upper extent and a smaller sealed lower extent with the upper extent secured to the lower end of the base, the holster portion positionable in an extended orientation with the lower extent projected from the lower end of the base and further positionable in a retracted orientation within the base.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
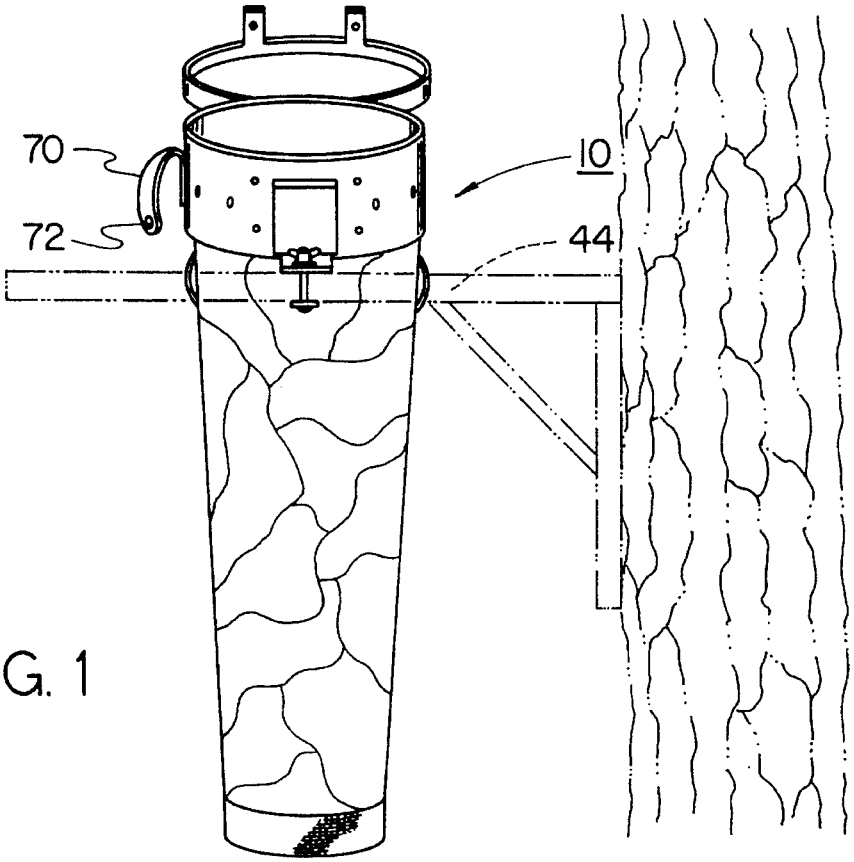
FIG. 1 is a perspective view of the preferred embodiment of the gun boot constructed in accordance with the principles of the present invention secured to a tree stand.

With reference now to the drawings, and in particular, to FIG. 1 thereof, the preferred embodiment of the new and improved gun boot embodying the principles and concepts of the present invention and generally designated by the reference number 10 will be described.

The present invention is comprised of a plurality of components. In their broadest context, such components include a base, mounting bracket, lids, and holster portion. Such components are individually configured and correlated with respect to each other to provide the intended function of carrying a weapon therein and allowing its securement to a tree stand.

Specifically, the gun boot includes a rigid base 12. The rigid base is formed of a plastic material. The base has a tubular configuration with an interior surface 14 and an exterior surface 16. The base also has an upper end 18 and a lower end 20. The base has a diameter such as to allow a weapon such as a rifle to be placed therethrough. Also provided is a rigid mounting bracket 30. The mounting bracket is formed of a first part 32 and a separate second part 34. The first part has an L-shape with a horizontal lower leg 36 and an upstanding upper leg 38. The first part also includes a bolt 40 with complimentary wing nut 42 for allowing the securement of the first part to a tree stand 44. The second part of the mounting bracket has a plate 46 secured to the exterior surface of the base and a section 48 with an L-shape extended downwards therefrom. The section and plate of the second part define a space therebetween for receiving the upper leg of the first part for coupling the base with a tree stand. The ends of the base are provided with lids. An upper lid 50 is included. The upper lid has a circular surface 52 positionable over the upper end of the base, a peripheral side wall 54 extended outwards from the surface, and an upper hinge 56 coupled between the side wall and exterior surface of the base. The hinge allows the upper lid to be pivoted with respect to the base. Also included is a snap 58 coupled between the upper lid and the exterior surface of the base at a location diametrically opposed from the upper hinge. The snap allows the lid to be secured to the base. The lower lid 60 has a circular surface 62 positionable over the lower end of the base, a peripheral side wall 64 extended outwards from the surface, and a lower hinge 66 coupled between the side wall and exterior surface of the base. This lower hinge is used for pivotally coupling the lower lid with the base. Also provided is a snap 68 coupled between the lower lid and exterior surface of the base at a location diametrically opposed from the lower hinge. The snap allows the lower lid to be secured to the base.

A flexible openable loop 70 is coupled to the exterior surface of the base. The loop is adapted to receive a rope for allowing the gun boot to be lifted and lowered from a tree stand. Additionally, the loop may be used for hanging scent therefrom for attracting game for hunting. The loop is secured to the exterior surface of the base with a snap 72.

Figure 2:
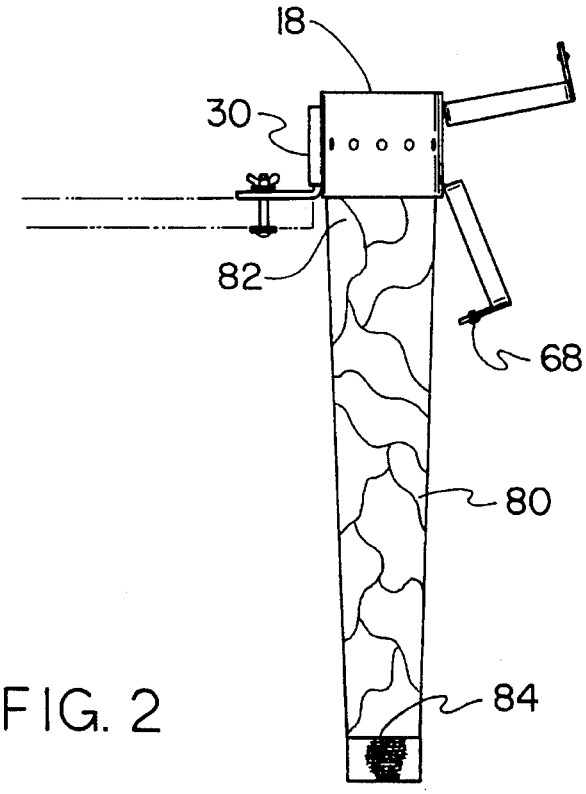
FIG. 2 is a front elevational view of the gun boot as shown in FIG. 1.
Figure 3:
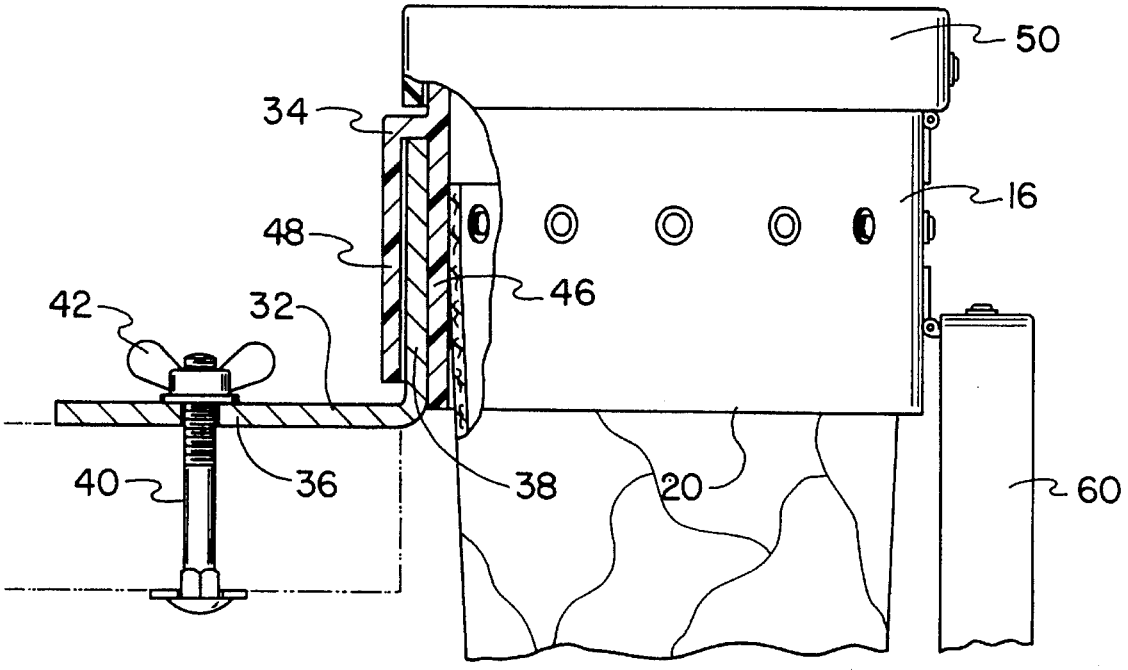
FIG. 3 is a cross-sectional view taken vertically through the top of the device of the prior figure.
Figure 4:
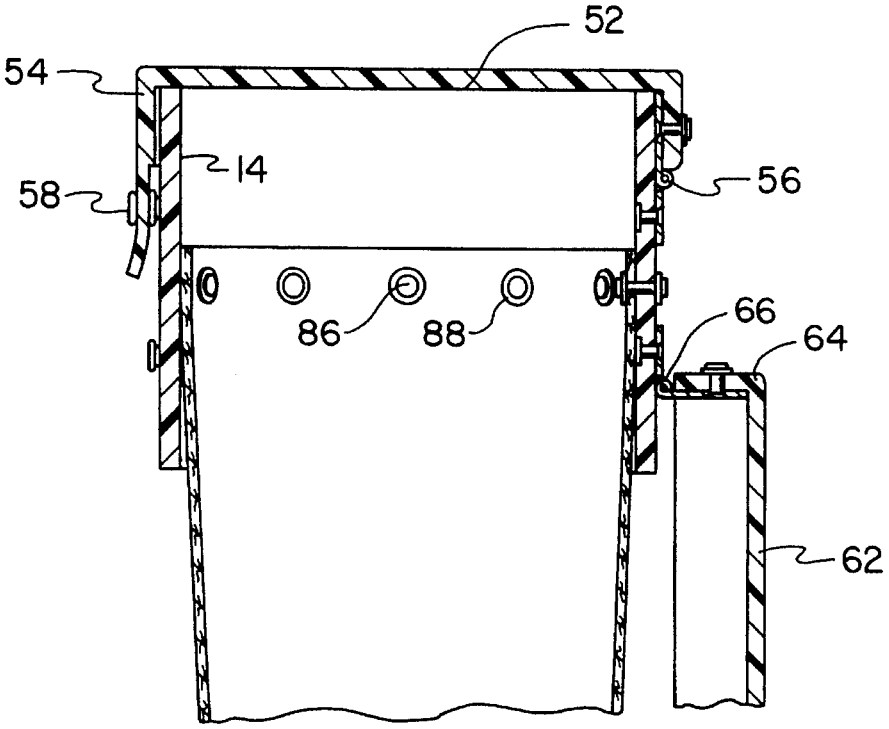
FIG. 4 is a cross-sectional view similar to that of FIG. 3.
Figure 5:
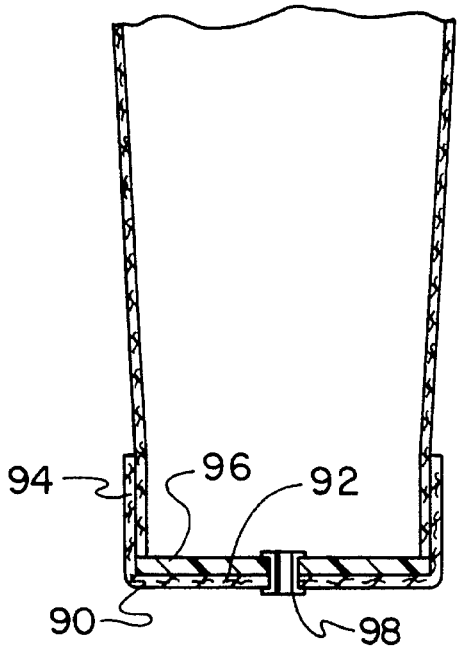
FIG. 5 is a cross-sectional view of the device of FIGS. 1 and 2 but taken at the lower end thereof.
Figure 6:
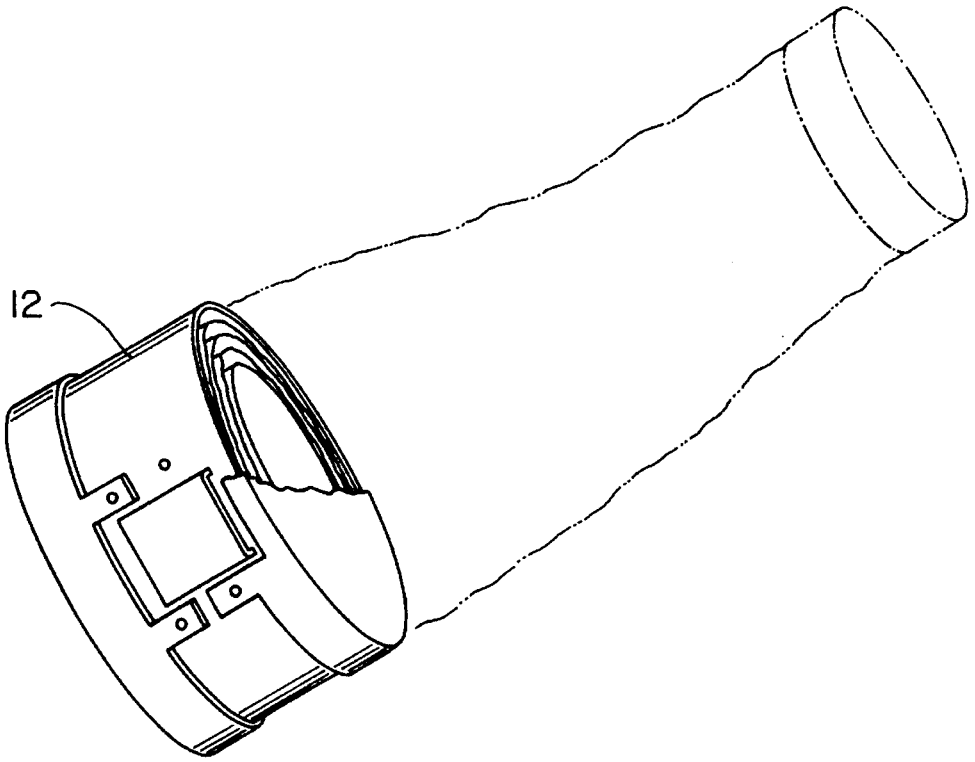
FIG. 6 is a perspective illustration showing the boot and sleeve collapsed into the base for storage and transportation.

To hold a weapon such as a rifle, shotgun or the like, a generally cone-shaped hollow holster portion 80 is provided. The holster portion is formed of a water-proof flexible plastic-impregnated fabric. This fabric has a camouflaged pattern thereon such as the desert or foliage type. The holster portion has a length at least two times greater than the diameter of the base for holding a long weapon therein. The holster portion has a larger open upper extent 82 and a smaller open lower extent 84. The larger open upper extent is provided for containing a butt of a weapon therein. The upper extent is secured to the interior surface of the base 14 with rivets 86 and complimentary washers 88. The holster portion additionally includes a cylindrical canvas end cap 90. The canvas end cap has a lower circular surface 92 and an upstanding cylindrical side wall 94. Also included is a generally circular plastic plate 96 secured to the end cap for maintaining the holster portion in a generally open position for receiving a weapon therein. The plastic plate is provided to preclude a barrel of a weapon from piercing through the end cap. A grommet 98 is extended through the plate and circular surface for effecting a coupling therebetween. The grommet is also utilized for allowing drainage through the holster portion. The holster portion is positionable in an extended configuration with the lower extent projected downwards from the base as shown in FIG. 2. Furthermore, the holster portion is positionable in a retracted orientation within the base as shown in FIG. 6. When placed in the retracted orientation, the holster portion can be sealed within the base with the lids, thereby placing the present invention in a stowed configuration that allows it to be readily transported from one location to another.

With the growing popularity of tree stand hunting, a need has developed for a device that will hold a shotgun, rifle or scope mounted rifle in a readily accessible position on a tree stand for hunting. The present invention satisfies this need. The present invention is a removable, compact case, that when opened, expands into a full length holster. It will hold a weapon in a tree stand and provide protection for it when raised and lowered. It is easily transportable in its collapsed state and readily attached to a tree stand. It will not hamper any bow holding device already mounted on a tree stand.

The present invention is designed to expand and hold a weapon while a hunter ascends up or descends down a tree. It will provide protection from debris clogging the barrel while raising and lowering a rifle or shotgun into a tree stand. It will provide a place to store the weapon while using other devices such as: calls, binoculars, and rattling sticks. It will provide the safety needed for securing a weapon while a hunter is sleeping or eating in a tree stand. The present invention is made of a protective plastic and a canvas end cap so a weapon will not be marred or scratched and provides protection from the soil.

The present invention will accommodate all sizes of rifles and shotguns, with, or without a scope. The mounting bracket is to be made of high grade aluminum and a stainless steel bolt and wing nut. The removable holster portion is to be made of high grade, temperature and chemical resistant plastic and includes a canvas boot. The holster portion and canvas boot will collapse into the plastic base for storage and transporting. The plastic base will have snapping lids on top and bottom for securing the present invention. It will also have a loop for raising and lowering the present invention and for hanging scent while in a tree stand.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A gun boot for holding a shotgun, rifle, or scope mounted rifle with respect to a tree stand while hunting comprising, in combination:

a rigid base formed in a tubular configuration having an interior surface and an exterior surface with an upper end and a lower end;

a rigid mounting bracket formed of a first part and a separate second part, the first part having an L-shape with a horizontal lower leg, an upstanding upper leg, and coupling means for securing the lower leg to a tree stand, the second part having a plate secured to the exterior surface of the base and a section having an L-shape extended downwards therefrom with the section and plate defining a space therebetween for receiving the upper leg of the first part for coupling the base with a tree stand;

an upper lid having a circular surface positionable over the upper end of the base, a peripheral sidewall extended outwards from the surface, an upper hinge coupled between the sidewall and exterior surface of the base for pivotally coupling the upper lid with the base, and a snap formed between the upper lid and exterior surface of the base at a location diametrically opposed from the upper hinge for allowing the lid to be secured to the base;

a lower lid having a circular surface positionable over the lower end of the base, a peripheral sidewall extended outwards from the surface, a lower hinge coupled between the sidewall and exterior surface of the base for pivotally coupling the lower lid with the base, and a snap formed between the lower lid and exterior surface of the base at a location diametrically opposed from the lower hinge for allowing the lid to be secured to the base;

a flexible openable loop coupled to the exterior surface of the base with the loop adapted to receive a rope for allowing the gun boot to be lifted and lowered from a tree stand; and a generally cone-shaped hollow holster portion formed of a waterproof flexible plastic impregnated fabric with a camouflaged pattern having a larger open upper extent and a smaller open lower extent with the upper extent secured to the interior surface of the base, the holster portion additionally having a cylindrical canvas end cap with a lower circular surface and an upstanding cylindrical side wall secured to the lower extent thereof, a plastic plate secured to the end cap, and a grommet extending through the plate and circular surface for effecting a coupling therebetween, the holster portion positionable in an extended configuration with the lower extent projected downwards from the base and further positionable in a retracted orientation within the base.

2. A gun boot comprising:

a hollow base having an open upper end and an open lower end;

a mounting bracket secured to the base and removably securable to a tree stand;

an upper lid removably coupled to the upper end of the base;

a lower lid removably coupled to the lower end of the base; and a generally cone-shaped hollow flexible holster portion having a larger open upper extent and a smaller sealed lower extent with the upper extent secured to the lower end of the base, the holster portion positionable in an extended orientation with the lower extent projected from the lower end of the base and further positionable in a retracted orientation within the base.

3. The gun boot as set forth in claim 2 wherein the upper lid and lower lid are pivotally coupled to the base.

4. The gun boot as set forth in claim 2 wherein the holster portion is formed of a waterproof flexible plastic impregnated fabric with a camouflaged pattern.

5. The gun boot as set forth in claim 2 further including first securement means for securing the upper lid to the base.

6. The gun boot as set forth in claim 2 further including second securement means for securing the lower lid to the base.

7. The gun boot as set forth in claim 2 further including a loop coupled to the exterior surface of the base with the loop adapted to receive a rope for allowing the gun boot to be lifted and lowered from a tree stand.

8. The gun boot as set forth in claim 2 further including means coupled to the holster portion for allowing drainage therefrom.

* * * * *